United States Patent [19]

Mattina, Jr. et al.

[11] Patent Number: 4,489,739

[45] Date of Patent: Dec. 25, 1984

[54] SMOKABLE TOBACCO COMPOSITION AND METHOD OF MAKING

[75] Inventors: Charles F. Mattina, Jr.; William A. Selke, both of Berkshire County, Mass.

[73] Assignee: Kimberly-Clark Corporation, Neenah, Wis.

[21] Appl. No.: 381,123

[22] Filed: May 24, 1982

[51] Int. Cl.[3] ..... A24B 15/28

[52] U.S. Cl. ..... 131/352; 131/353; 131/334

[58] Field of Search ..... 131/352, 358, 359, 353, 131/334

[56] References Cited

U.S. PATENT DOCUMENTS 3,744,496 7/1973 McCarty et al. ..... 131/342

*Primary Examiner*—Vincent Millin

*Attorney, Agent, or Firm*—William D. Herrick; R. Jonathan Peters; Howard Olevsky

[57] ABSTRACT

Smokable tobacco compositions having a reduced tendency to produce carbon monoxide and made by including in the composition an alkali-metal salt of a carboxylic acid in the range of from about 6.5 to about 20%. Such additives have been included in smoking compositions in the past, but normally in minor amounts and as burn enhancers. In accordance with the invention increased amounts result in greatly reduced production of undesirable carbon monoxide while not otherwise adversely affecting the tobacco smokable composition. At higher concentrations such additives may retard burn which may be further desirable where fast burning tobacco compositions are employed. Examples of alkali-metal salts include sodium or potassium salts of acids such as carbonic, formic, acetic, propionic, malic, lactic, glycolic, citric, tartaric, fumaric, malonic, and succinic.

10 Claims, No Drawings

SMOKABLE TOBACCO COMPOSITION AND METHOD OF MAKING

BACKGROUND OF THE INVENTION

1. Field of the Invention

The invention is directed to tobacco and reconstituted tobacco smoking compositions and products and methods of making them. More specifically, it relates to such compositions and products and methods which result in substantially reduced quantities of carbon monoxide in the smoke produced when smoking such products.

Reconstituted tobacco smokable compositions and products are well-known. One way of producing reconstituted tobacco is to extract the soluble ingredients of natural tobacco, which preferably has been macerated or comminuted in preparation for extraction. The extraction may be performed using water, and generally from 30 to 55% of the weight of the starting material is withdrawn. An aqeous slurry is then formed containing the fibers and, by ordinary papermaking techniques, the slurry (with or without additives) is transformed into a self-sustaining web. The tobacco extract, which may be concentrated to a liquor, may be then introduced into the web. The application of the extracted tobacco may be achieved in any appropriate manner, as by spraying, saturating or otherwise.

Natural tobacco smoking compositions and products utilizing leaves, lamina, stem or stock, are also well-known. Such natural tobacco compositions (with or without additives) may be shredded or otherwise subdivided and the shreds or particles formed into rods which are wrapped to form cigarettes. Such compositions may, of course, be utilized in other forms as pipe tobacco or, in whole leaf form, as wrappers for cigars and the like.

In all of these forms, when smoked, there is a resulting production of carbon monoxide which is generally recognized as undesirable. There is, therefore, a need to produce such compositions and smoking tobacco products that result in reduced production of carbon monoxide.

2. Description of the Prior Art

The addition of salts to effect changes in combustion is known. For example, Briskin and Ward U.S. Pat. No. 3,612,063 dated Oct. 12, 1971 teaches the addition of low levels (less than 2% by weight) of potassium salts of certain organic acids to oxidize cellulose for the purpose of controlling burn. U.S. Pat. No. 3,556,109, also to Briskin and Ward issued Jan. 19, 1971 teaches that high levels (up to 30%) of alkaline earth salts of carboxylic acids modify the ash forming characteristics of cellulose materials. There are other patents concerned with modifications of cellulosic webs, in contradistinction to tobacco for reconstituted tobacco materials; for example, U.S. Pat. No. 4,197,861 to Keith issued April 15, 1980 describes the addition of alkali and alkaline earth metal salts of carbonic acids in minor amounts (0.5 to 5%) to cellulose based synthetic smoking materials to impart a commercially acceptable burning rate to the material. Such patents fail to suggest that alkali-metal salts of carboxylic acids at any addition levels result in a reduction in the generation of carbon monoxide. U.S. Pat. No. 3,924,642 to Eicher, Muller and Krebs issued Dec. 9, 1975 discloses the treatment of cellulosic webs with mixed salts (salts of alkaline earth metals and iron or aluminum) of chelate-forming carboxylic acids. The patent teaches the addition of from 0.01% to 7% of alkali-metal or alkaline earth metal nitrates or alkali-metal permanganates, as oxidizing agents, neither of which compounds (either in the amounts claimed or in higher amounts) produces nearly the desired effect of reducing the level of carbon monoxide generated without introducing extremely fast burn rates and an increase in undesirable compounds in the smoke. U.S. Pat. No. 4,296,762 to Eicher and Muller dated Oct. 27, 1981 discloses a method for the addition of finely divided inorganic fillers (such as oxides, hydroxides or hydrated oxides of aluminum, iron, manganese, zinc, titanium and silicon) to synthetic smoking materials based on cellulose. As an aid to dispersing these inorganic fillers, patentees suggest the use of alkali-metal, ammonium, alkaline earth metal, iron, aluminum, manganese or zinc salts of carboxylic acids, preferably as chelate salts. In general these patents relate to the treatment of cellulose based or other synthetic smoking materials.

The treatment of tobacco or reconstituted tobacco is also known. For example, U.S. Pat. No. 3,760,815 to Deszyck issued Sept. 25, 1973 teaches that the addition of ammonium salts of organic acids to tobacco releases tobacco pectins from the tobacco; as mentioned above, addition of these ammonium salts of carboxylic acids has no salubrious effect upon the generation of carbon monoxide. U.S. Pat. No. 4,006,749 to Horowitz, Dichter and Abrams issued Feb. 8, 1977 describes a process for grafting onto tobacco vinyl polymers containing, in one variation, functional groups that include the carboxyl moiety; the purpose of this modification is to scavenge alkaline compounds from the smoke. U.S. Pat. No. 4,033,359 to Borthwick and Morman issued July 5, 1977 discloses the addition of small amounts of potassium citrate (3.9% to 4.3%) to tobacco based smoking mixtures for the purpose of obtaining acceptable rates of combustion; at these levels of addition burn acceleration, not retardation, occurs and there is no favorable influence over the generation of carbon monoxide. Finally, U.S. Pat. No. 4,119,104 to Roth issued Oct. 10, 1978 teaches the addition of nitrates and citrates as burn accelerators to tobacco substitutes; in patentee's type of smoking mixture, the addition of high levels of alkali-metal salts of carboxylic acids does indeed have the effect of increasing the rate of burn, but there is no favorable effect upon the combustion which would reduce the generation of carbon monoxide.

SUMMARY

The present invention relates to reduction of undesirable smoking by-products, specifically carbon monoxide. In accordance with the invention, smokable compositions and products having reduced generation of carbon monoxide are produced by the addition of high amounts, about 6.5 to about 20%, by weight based on the total tobacco composition of an alkali-metal salt of a carboxylic acid to a tobacco based composition including about 50% to 100% by weight tobacco. In particular, alkali-metal salts of acids such as carbonic, formic, acetic, propionic, malic, lactic, glycolic, citric, tartaric, fumaric, malonic and succinic are preferred. In a particularly preferred embodiment, such salts are added in the amount of about 9 to about 16% by weight. Various means may be utilized to incorporate the salts such as spraying, dipping, or other applications, and the process of the invention is useful with reconstituted tobacco compositions as well as natural tobacco compositions.

Smokable compositions and products including them demonstrate significant reductions in production of carbon monoxide, for example 50% or more per puff and 25% or more on a per cigarette basis. These results are accomplished substantially without adverse effect on other favorable properties of the smokable compositions and products.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

The following examples illustrate features of the invention:

EXAMPLE I

A blend of tobacco was prepared with the following proportions:

25 percent burley midribs
25 percent flue-cured midribs
25 percent burley dust
25 percent flue-cured dust This blend was extracted with water and the fibrous residue was formed into a sheet by ordinary papermaking handsheet forming techniques. The extract was concentrated and potassium citrate added thereto in such an amount that, following the application of the extract to the sheet by means of a sizepress and subsequent drying, the amount of potassium citrate in the sheet was 10.5%. A suitable control was made in exactly the same manner except that no potassium citrate was added to the concentrated extract.

Both sheets were then shredded and made into cigarettes wrapped with conventional cigarette paper having a CORESTA permeability of 30 centimeters per minute and 0.6% citrate (as citric acid). The cigarettes so fashioned were 70 millimeters long and 25 millimeters in circumference. These were smoked on a smoking machine under standard conditions set by the Federal Trade Commission, i.e. puffs of thirty-five cubic centimeters volume and two seconds duration taken once each minute. The smoke from these cigarettes was analyzed for total particulate matter (TPM), dry particulate matter (TPM−water=DPM) and carbon monoxide. The data, presented in Table I, clearly show a reduction of approximately two-thirds in the per puff carbon monoxide and 40% on a per cigarette basis.

EXAMPLE II

The procedures of Example I were followed except that the blend consisted of:

43 percent burley midribs
22 percent flue-cured midribs
5 percent burley dust
30 percent flue-cured dust Cigarettes were smoked in similar fashion to Example I. The data are in Table I and indicate reductions similar to those for the blend used in Example I.

EXAMPLE III

The procedures of Example I were followed except that sodium citrate was added to the concentrated extract in an amount such that the finished reconstituted tobacco was 8% in sodium citrate. The data are in Table I. Reductions of 50% in the per puff CO and 25% on a per cigarette basis are evident.

EXAMPLE IV

The procedures of Example I were followed in the preparation of two samples, one with 6% potassium citrate (IV-A), another with 16% potassium citrate (IV-B). The data, in Table I, show only small reductions at the 6% level (23% per puff, 0% per cigarette). At the 16% level, the reductions are quite substantial (80% per puff, 55% per cigarette). This level of 16% salt probably represents nearly the upper limit of practical use for potassium citrate since the puff number is quite high and the cigarettes barely support smolder between puffs.

EXAMPLE V

The procedures of Example I were followed in the preparation of four additional samples: V-A, 11% ammonium citrate; V-B, 10% ferric ammonium citrate; V-C, 12% magnesium citrate; V-D, 13% potassium nitrate. The data are in Table I. Sample V-A shows a reduction of 11% in the per puff carbon monoxide and an increase of 24% in the level of that gas on a per cigarette basis. Sample V-B shows both per puff and per cigarette increases of 4% and 40% respectively. Sample V-C gives no change on a per puff basis and an increase of 13% per cigarette. Sample V-D shows reductions per puff (23%) and per cigarette (48%) but the number of puffs is reduced to an extremely low 3.7 puffs.

EXAMPLE VI

The procedures of Example I were followed in the preparation of two additional samples: VI-A having 12% potassium acetate, and VI-B with 10% sodium potassium tartrate. The data in Table I shown reductions of 80% (per puff) and 60% (per cigarette) for potassium acetate; also 55% (per puff) and 20% (per cigarette) for sodium potassium tartrate.

EXAMPLE VII

Natural shredded tobacco, typical of that used in a Standard American Blend, was sprayed with a solution of potassium citrate so that, after drying, the amount of potassium citrate applied was 12% of the weight of the tobacco. Cigarettes were made with this tobacco and with untreated tobacco; these were smoked in the manner described in Example I. The data are in Table I. There was a reduction in per puff carbon monoxide of 40% and on a per cigarette basis of 25%.

TABLE I

| Example | No. of Puffs | (cc) Carbon Monoxide /Puff | (cc) Carbon Monoxide /Cigarette | (mg) Dry Particulate Matter (DPM) |
|---|---|---|---|---|
| I control | 5.5 | 3.00 | 16.5 | 14.0 |
| treated | 9.2 | 0.90 | 8.3 | 11.0 |
| II control | 6.0 | 3.02 | 18.1 | 15.5 |
| treated | 9.2 | 0.89 | 8.2 | 11.8 |
| III | 8.5 | 1.45 | 12.3 | 12.0 |
| IV-A | 6.6 | 2.20 | 14.5 | 14.0 |
| IV-B | 12.0 | 0.60 | 7.2 | 10.2 |
| V-A | 7.7 | 2.66 | 20.5 | 17.4 |
| V-B | 7.4 | 3.12 | 23.1 | 14.0 |
| V-C | 6.2 | 3.00 | 18.6 | 14.6 |
| V-D | 3.7 | 2.30 | 8.5 | 9.3 |
| VI-A | 10.9 | 0.60 | 6.6 | 10.4 |
| VI-B | 8.2 | 1.33 | 10.9 | 11.6 |
| VII control | 8.0 | 1.66 | 13.3 | 25.7 |

TABLE I-continued

| Example | No. of Puffs | (cc) Carbon Monoxide /Puff | (cc) Carbon Monoxide /Cigarette | (mg) Dry Particulate Matter (DPM) |
|---|---|---|---|---|
| VII treated | 9.9 | 1.00 | 9.9 | 20.3 |

It is also within the scope of the present invention to include in the composition minor amounts of conventional additives such as fillers, including chalk, flavorants and the like as long as the tobacco constituents comprise at least 50% by weight prior to salt addition. Also, as will be recognized by those skilled in the art, various means may be employed to apply the composition such as spraying, dipping or other application a solution of the salt so that after the application the percentage of the alkali-metal salt remaining is in the range of from about 6.5 to about 20%, preferably from about 9 to about 16% of the finished weight of the treated tobacco composition, including additives, if any, on a moisture free basis.

While these salts normally act as burn accelerators when added in low amounts to tobacco or reconstituted tobacco or when added in higher amounts to certain synthetic smoking compositions which may or may not include tobacco in their formulations, it is a particular feature of the present invention that addition of these salts to tobacco or reconstituted tobacco, in high amounts, results in a retardation of the rate of burn and also salubrious effects upon the generation of carbon monoxide.

Reduction of the delivery of carbon monoxide is generally acknowledged to be desirable. When tobacco or reconstituted tobacco is burned in a smoking article such as a cigarette, cigar or pipe, substantial quantities of carbon monoxide are formed in the smoke through both combustion and pyrolysis. The level of this gas in the smoke reaching the smoker's mouth can be attenuated by dilution with air through the cigarette wrapper, for example, or through the use of a ventilated filter tip. Substantial reductions in the level of carbon monoxide can be achieved in this fashion. However, such reductions in carbon monoxide are also accompanied by the reduction of other constituents in the smoke, many of which are important for flavor and taste. The present invention, in contradistinction, provides a means of altering the combustion of the tobacco or reconstituted tobacco resulting in a specific decrease in the amount of carbon monoxide generated with only minimal effects upon the other components of the smoke.

This is clearly demonstrated in Table I which shows that reductions in carbon monoxide ranging from 25% to greater than 50% (on a per cigarette basis) may be achieved in accordance with the present invention. While specific salts of carboxylic acids have been demonstrated to be effective, the present invention is applicable generally to those alkali metal salts of mono-, di-, or tri-carboxylic acids, or of hydroxy acids having equivalent weights of less than 150 grams/equivalent and preferably less than 100 grams/equivalent.

While the invention is not to be limited to any particular theory, it is believed that these beneficial results are obtained by alteration of the combustion pathway.

Thus it is apparent that there has been provided, in accordance with the invention, smokable compositions and products and a method for manufacturing them that fully satisfy the objects, aims, and advantages set forth above. While the invention has been described in conjunction with specific embodiments thereof, it is evident that many alternatives, modifications, and variations would be apparent to those skilled in the art in light of the foregoing description. Accordingly, it is intended to embrace all such alternatives, modifications, and variations as fall within the spirit and scope of the appended claims.

We claim:

1. A shredded, smokable tobacco composition comprising about 50% to 100% by weight tobacco and having added thereto about 6.5 to about 20% based on the weight of the composition of one or more alkali-metal salts of carboxylic acids selected from the group consisting of mono-, di-, and tri-carboxylic acids having an equivalent weight less than 150 grams per equivalent, whereby said shredded smokable tobacco composition produces reduced generation of carbon monoxide upon smoking.

2. The composition of claim 1 wherein said alkali metal is selected from the group consisting of sodium and potassium.

3. The composition of claims 1 or 2 wherein said salt has an equivalent weight of less than 100 grams/equivalent.

4. The composition of claim 1 wherein said salt is selected from the group consisting of sodium and potassium salts of carbonic, formic, acetic, propionic, malic, lactic, glycolic, citric, tartaric, fumaric, malonic and succinic acids.

5. The composition of claim 1 or 4 wherein the amount of salt added is in the range of from about 9 to 16% by weight.

6. A method of producing shredded smokable tobacco compositions having reduced tendency to generate carbon monoxide upon smoking comprising the step of adding to a shredded tobacco composition containing about 50% to 100% tobacco about 6.5 to 20% based on the total weight of the composition of one or more alkali metal salts of carboxylic acids selected from the group consisting of mono, di-, or tri-carboxylic acids having an equivalent weight less than 150 grams-/equivalent.

7. The method of claim 6 wherein said alkali metal is selected from the group consisting of sodium and potassium.

8. The method of claims 6 or 7 wherein said salt has an equivalent weight of less than 100 grams/equivalent.

9. The method of claim 6 wherein said salt is selected from the group consisting of sodium and potassium salts of carbonic, formic, acetic, propionic, malic, lactic, glycolic, citric, tartaric, fumaric, malonic and succinic acids.

10. The method of claims 6 or 9 wherein the amount of salt added is in the range of from about 9 to 16% by weight.

* * * * *